US005389011A

United States Patent [19]

Eder

[11] Patent Number: 5,389,011

[45] Date of Patent: Feb. 14, 1995

[54] ELECTRICAL RECEPTACLE OR SWITCH WITH BUILT-IN WIRE STRIPPER AND LOOPER

[75] Inventor: John M. Eder, Floral Park, N.Y.

[73] Assignee: Eagle Electric Mfg. Co., Inc., New York, N.Y.

[21] Appl. No.: 20,422

[22] Filed: Feb. 22, 1993

[51] Int. Cl.[6] ..... H01R 33/945

[52] U.S. Cl. ..... 439/577; 439/538

[58] Field of Search ..... 439/538, 577; 7/107; 29/564.4

[56] References Cited

U.S. PATENT DOCUMENTS

| | | | |
|---|---|---|---|
| 2,317,382 | 4/1943 | Hubbell | 439/577 |
| 3,417,368 | 12/1968 | Norden | 439/577 |
| 4,688,135 | 8/1987 | Leopold | 439/577 |
| 4,877,924 | 10/1989 | Mitzmacher | 439/577 |

*Primary Examiner*—P. W. Echols

*Attorney, Agent, or Firm*—Kirschstein, Ottinger, Israel & Schiffmiller

[57] ABSTRACT

A wire stripper and/or a wire looper are integrally formed in a mounting strap or body of an electrical device, such as a duplex receptacle or wall switch, in order to simplify a wiring installation without requiring an installer to use separate tools.

9 Claims, 2 Drawing Sheets

ELECTRICAL RECEPTACLE OR SWITCH WITH BUILT-IN WIRE STRIPPER AND LOOPER

BACKGROUND OF THE INVENTION

1. Field of the Invention

This invention generally relates to an electrical receptacle or switch mounted in a wall-mounted electrical junction box and, more particularly, to facilitating the preparation of one or more electrical lead wires to be connected to one or more electrical terminations on the receptacle or switch.

2. Description of Related Art

In order to connect an electrical lead wire to a termination on an electrical device such as a receptacle or switch mounted in a wall junction box, it is known, for example, from U.S. Pat. Nos. 698,567; 2,620,692 and 3,180,184 to use a separate wire stripper tool, such as a knife, razor blade, wire stripper or cutting pliers, to strip electrical insulation off the lead wire. It is also known from U.S. Pat. No. 4,877,924 to incorporate a wire stripper in a wire connector or nut used to splice wires together.

After the insulation has been stripped from the lead wire, it is known to bend its conductive core into a loop for encircling a termination screw on the device. Again, it is known to use separate tools, such as needlenose pliers, for this purpose, and also it is known from U.S. Pat. No. 2,317,382 to use the plastic body of an electrical receptacle to form the loop.

SUMMARY OF THE INVENTION

Objects of the Invention

It is a general object of this invention to incorporate a wire stripper on an electrical device itself, and particularly in a mounting strap thereof.

It is another object of this invention to incorporate a wire looper on the electrical device itself, particularly in a mounting strap thereof.

Another object of this invention is to eliminate the need for additional separate tools to strip the wire and/or to loop its conductive core.

A further object of this invention is to simplify a wiring installation, especially for a homeowner or do-it-yourselfer, who may not have a wire stripper and/or a wire looper handy.

Features of the Invention

In keeping with these objects, and others which will become apparent hereinafter, one feature of this invention resides, briefly stated, in a wire-stripping electrical device, such as a duplex receptacle or a wall switch, which comprises a mounting strap mounted on, or integral with, an electrically-insulating body. An electrical termination is mounted on or in the body for connection to an electrical lead wire.

In accordance with this invention, wire stripper means is integrally formed with the strap or body, and is operative for stripping an electrically-insulating jacket off an electrically-conductive core of the lead wire prior to connection to the termination. Advantageously, the wire stripper means is constituted by a cutting edge formed at an end region of the strap. The cutting edge has cutting portions mutually spaced apart by a distance generally equal to the diameter of the core of the wire. Since two sizes of wiring are omnipresent in home wiring, namely, No. 12 and No. 14 gauge wire, a pair of cutting edges is provided, each having cutting portions sized to the core diameter of either the No. 12 or the No. 14 gauge wire.

The wire stripper means may be located anywhere on the mounting strap or body and, in one preferred embodiment, two pairs of cutting edges are provided on opposite lateral sides of one of the strap end regions. In a variation, wherein each strap end region is provided with a pair of washer-type plaster ears having an aperture, the cutting portions of each cutting edge extend into a respective aperture of the ears.

In accordance with another feature of this invention, wire looper means is integrally formed with the strap, and is operative for looping the core of the stripped wire. The wire looper means includes a looper opening sized to accommodate a range of core diameters from No. 14 to No. 10 gauge wire. The opening extends through the strap. Multiple openings sized for different gauge wires could also be used.

In order to connect the electrical lead wire to the termination on the device, it is merely necessary to hold the device in one's hand, slide the wire lengthwise along the cutting portions, rotate the device or wire relative to each other to insure that the insulation has been cut around its entire circumference and, thereupon, to pull the wire along its length in a direction perpendicularly of the cutting portions, thereby removing the cut insulation and exposing the core. The exposed core may then either be pushed into a rear opening on the body in a back-wiring installation, or may be looped for a screw-mounted termination. In order to loop the exposed core, the device is again held in one's hand, the core is inserted into the looper opening and, thereupon, a twisting motion is effected between the device and the wire, thereby bending the exposed core. The bent core may now be positioned underneath the head of a screw termination. Tightening the screw completes the wiring installation.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
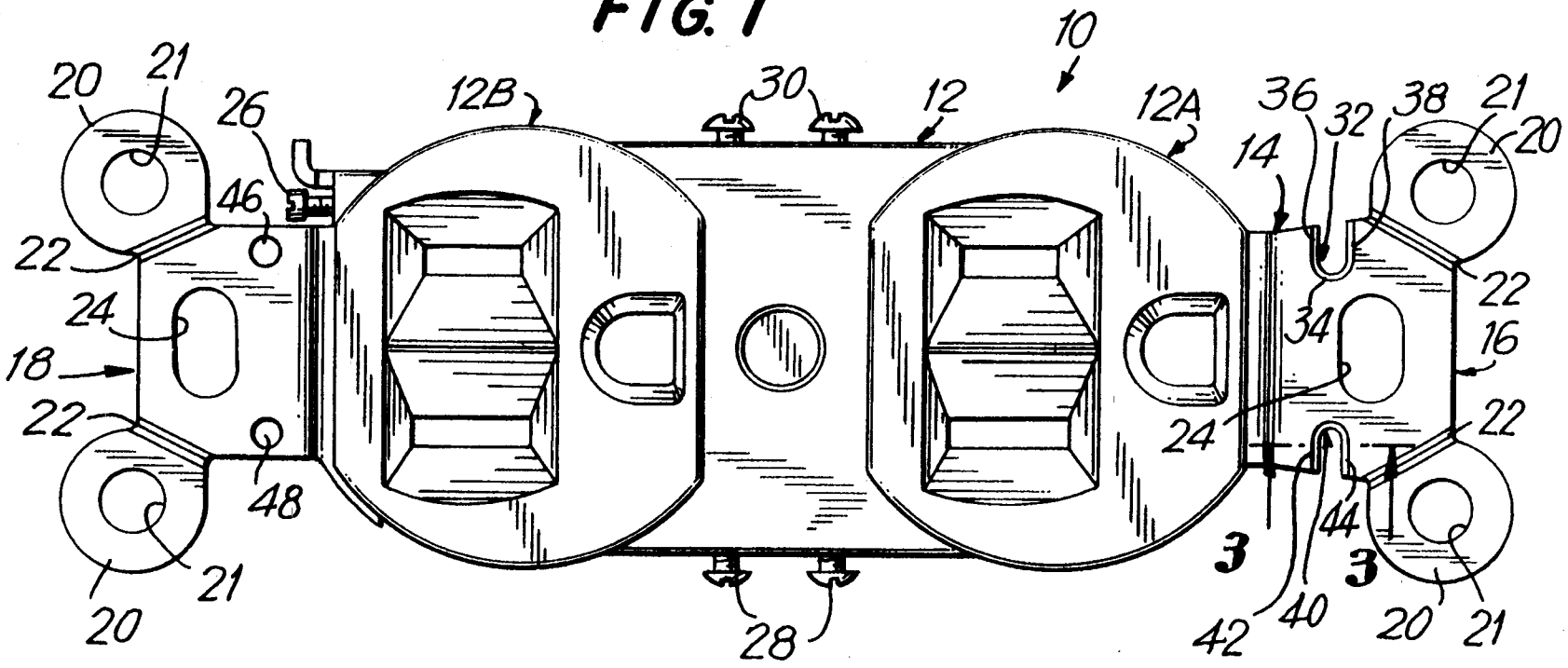
FIG. 1 is a top plan view of a duplex electrical receptacle having incorporated therein a pair of wire strippers and a pair of wire loopers in accordance with this invention.

Referring to FIG. 1, reference numeral 10 generally identifies a duplex electrical receptacle having an electrically-insulating plastic body 12 formed with a pair of electrical outlets 12A, 12B. An electrically-conductive metal mounting strap 14 is mounted on the body 12. The mounting strap 14 could also be constituted of plastic and be molded integral with the body 12. The body and the strap are both elongated along the same direction, and the strap has opposite end regions or extensions 16, 18 extending past opposite ends of the body. Each extension 16, 18 has a pair of washer-type plaster ears 20 having interior apertures 21. Each ear 20 is connected to the strap 14 by a scored bending line 22 about which a respective ear can be bent to break the ear off the strap for use as a spacer. Each extension 16, 18 has a mounting hole 24 through which a mounting screw passes for mounting the receptacle on a non-illustrated wall-mounted junction box.

The duplex electrical receptacle 10 further includes a grounding termination including a grounding screw 26 threaded into the strap 14, and two pairs of power terminations, one pair for each outlet, each power termination including power screws 28, 30.

Figure 3:
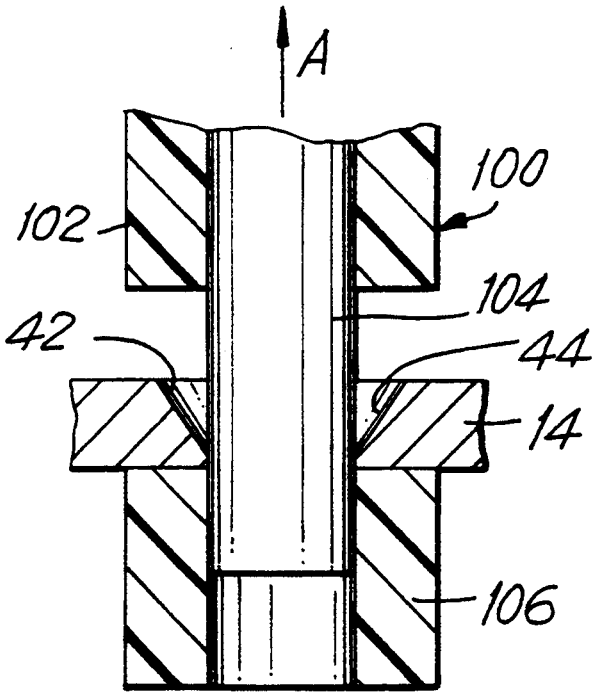
FIG. 3 is a sectional view depicting how a wire is stripped in accordance with this invention.

As described so far, the electrical receptacle is entirely conventional and, in use, is connected to electrical lead wires in the junction box. As depicted in FIG. 3, a lead wire 100 has an electrically-insulating jacket or insulation 102 surrounding an electrically-conductive cylindrical core 104. The core diameter and the diameter of the wire itself come in various sizes. The most popular sizes in home or office wiring installations are No. 12 AWG and No. 14 AWG. After the wire 100 has been stripped and its core 104 looped as described below, the core is placed under the head of a respective screw 26, 28, 30 and, thereupon, the respective screw is tightened. This procedure is repeated for the remaining screws to complete the wiring of the receptacle.

In accordance with this invention, a wire stripper 32 is integrally formed with the strap 14. The stripper 32 includes a coined, sharp cutting edge 34. As shown in FIG. 1, the cutting edge 34 has a U-shaped configuration; however, other configurations, such as a V-shaped configuration, are also contemplated. The V-shaped cutting edge can accommodate and strip a wider range of wire sizes. The cutting edge 34 has a pair of cutting portions 36, 38 mutually spaced apart from each other along generally parallel lines by a distance equal to the diameter of the core of the wire. As illustrated, the cutting portions 36, 38 are spaced apart by the core diameter of a No. 12 gauge wire.

Another wire stripper 40 is integrally formed with the strap, and has a generally U-shaped configuration with generally linear cutting portions 42, 44 mutually spaced apart along parallel lines by a distance equal to the core diameter of a No. 14 gauge wire. The wire strippers 32, 40 are illustrated as being located at opposite lateral sides of the strap extension 16. In an alternate embodiment, either one or both of the wire strippers 32, 40 could be provided on the other strap extension 18.

Figure 2:
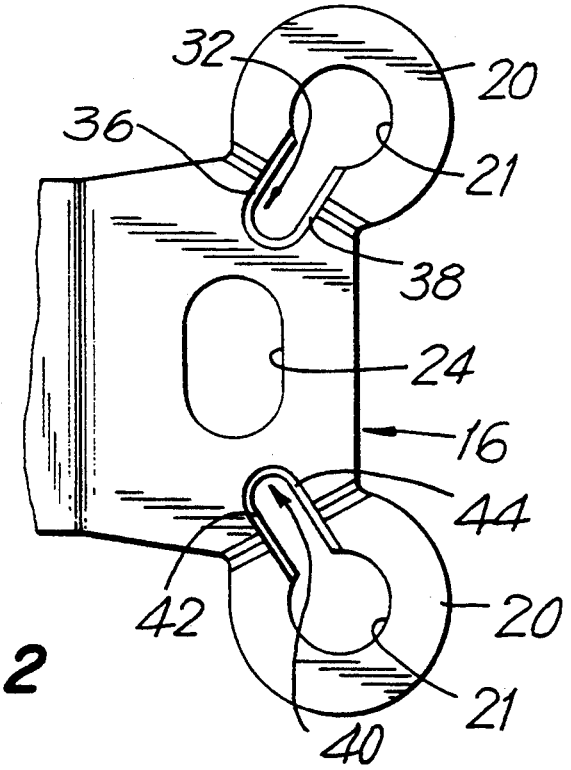
FIG. 2 is a broken-away, top plan view of a mounting strap having a pair of modified wire strippers incorporated therein.

Each wire stripper could be located anywhere on a respective strap extension. Thus, as shown in FIG. 2, wire strippers 32, 40 could have their respective cutting portions 36, 38 and 42, 44 extending into the apertures 21 of the ears 20. The apertures 21 are large enough so that either a No. 12 or No. 14 gauge wire can be inserted therein with clearance.

In use, in order to strip a lead wire 100, it is merely necessary for one to hold the receptacle 10 in one's hand and slide the wire through either stripper 32 or 40 lengthwise along the cutting portions 36, 38, or 42, 44. In the FIG. 1 embodiment, access to either stripper 32, 40 is readily obtainable from either lateral side of the strap extension 16, and the sliding movement is continued until the wire bottoms out at the closed end of the cutting edge. In the case of the FIG. 2 embodiment, access to the strippers 32, 40 is achieved by first inserting the wire into the aperture 21 prior to sliding the wire lengthwise along the cutting portions 36, 38 or 42, 44, again until the wire bottoms out at the closed end of the cutting edge.

Next, the device is rotated about the wire or the wire is rotated about its longitudinal axis, thereby insuring that the insulation 102 has been severed around the entire circumference of the wire. Thereupon, the wire is pulled along its length in a direction transverse to the elongation of the cutting portions, i.e., in the direction of the arrow A in FIG. 3. The cut insulation 106 is pulled from the wire, thereby exposing the core 104 for a predetermined distance. In this condition, the wire may be inserted into a hole in the back of the receptacle in a back-wiring installation.

In further accordance with this invention, a wire looper is also integrally formed with the strap, and is operative for looping the exposed core of the stripped wire. The wire looper includes a looper opening 46 sized to accommodate the cores of various stripped wires, e.g., No. 10, No. 12 and No. 14 gauge wire. The opening 46 extends entirely through the strap 14. The opening 46 may be provided at either strap extension 18 as illustrated, or at extension 16, or, for that matter, anywhere along the strap. For some applications, another opening 48 sized to accommodate the core of a different gauge wire could be provided.

In use, in order to loop the exposed core 104, it is again necessary for one to hold the receptacle in one's hand and, thereupon, the exposed core is inserted into either the opening 46 or 48. Next, a twisting motion is effected between the receptacle and the wire, thereby bending the core 104 into a hook or similar U-shaped configuration. The bent core may then be inserted under the head of any of the screws 26, 28, 30. Tightening the selected screw captures the core thereunder. This procedure is repeated for additional wires and additional screws to be terminated.

This invention is not intended to be limited to the wiring of duplex electrical receptacles, since other electrical devices, such as switches, may also be wired and looped as described above.

It will be understood that each of the elements described above, or two or more together, also may find a useful application in other types of constructions differing from the types described above.

While the invention has been illustrated and described as embodied in an electrical receptacle or switch with built-in wire stripper and looper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A wire-stripping, box-mounted electrical device, comprising:

(a) an elongated electrically-insulating body having opposite ends;

(b) an elongated metal mounting strap on the body and having opposite strap end regions extending past the opposite ends of the body, each strap end region having means for mounting the device on a junction box;

(c) an electrical termination on the body for connection to an electrical wire and in the box; and (d) wire stripper means integrally formed with one of the strap end regions, and operative for stripping an electrically-insulating jacket off an electrically-conductive core of the wire prior to connection to the termination.

2. An electrical device according to claim 1, wherein the wire stripper means includes a cutting edge having cutting portions mutually spaced apart by a distance generally equal to the diameter of the core of the wire.

3. An electrical device according to claim 2, wherein the cutting edge has a generally U-shaped configuration.

4. An electrical device according to claim 1, wherein said one strap end region has at least one washer-type ear having an aperture through which the wire is insertable with clearance, and wherein the wire stripper means includes a cutting edge having cutting portions extending from the aperture and mutually spaced apart by a distance generally equal to the diameter of the core of the wire.

5. An electrical device according to claim 4, wherein the aperture of said at least one ear is sized to accommodate the wire having a first gauge, and wherein said one strap end region has another washer-type ear having another aperture that is sized to accommodate a different wire having a second gauge different from the first gauge, and wherein the wire stripper means includes another cutting edge having cutting portions extending from the other aperture and mutually spaced apart by a distance generally equal to the diameter of the core of the second gauge wire.

6. An electrical device according to claim 1, wherein the wire stripper means includes at least one generally U-shaped cutting edge sized to accommodate a predetermined core diameter.

7. An electrical device according to claim 6, wherein the wire stripper means includes another generally U-shaped cutting edge sized to accommodate another core diameter different from said predetermined core diameter.

8. An electrical device according to claim 1; and further comprising wire looper means integrally formed with one of the strap and regions, and operative for looping the core of the stripped wire.

9. An electrical device according to claim 8, wherein the wire looper means includes an opening sized to accommodate a range of stripped wire cores, said opening extending through the strap.

* * * * *